US010794200B2

(12) United States Patent
Simonds

(10) Patent No.: US 10,794,200 B2
(45) **Date of Patent: *Oct. 6, 2020**

(54) INTEGRAL HALF VANE, RINGCASE, AND ID SHROUD

(71) Applicant: United Technologies Corporation, Farmington, CT (US)

(72) Inventor: Mark E. Simonds, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 39 days.

This patent is subject to a terminal disclaimer.

(21) Appl. No.: 16/184,632

(22) Filed: Nov. 8, 2018

(65) Prior Publication Data

US 2020/0088045 A1 Mar. 19, 2020

Related U.S. Application Data

(63) Continuation-in-part of application No. 16/131,766, filed on Sep. 14, 2018.

(51) Int. Cl.

| | |
|---|---|
| ***F01D 9/04*** | (2006.01) |
| ***F01D 25/24*** | (2006.01) |
| ***F01D 17/16*** | (2006.01) |

(52) U.S. Cl.

CPC ..... *F01D 9/04* (2013.01); *F01D 9/041* (2013.01); *F01D 9/044* (2013.01); *F01D 17/162* (2013.01); *F01D 25/24* (2013.01)

(58) Field of Classification Search

None

See application file for complete search history.

(56) References Cited

U.S. PATENT DOCUMENTS 3,442,493 A * 5/1969 Smith, Jr. ..... F04D 29/563 415/164

3,887,297 A 6/1975 Welchek (Continued)

FOREIGN PATENT DOCUMENTS

EP 1217173 A2 6/2002

EP 13405894 A2 9/2003

(Continued)

OTHER PUBLICATIONS

Extended European Search Report dated Feb. 3, 2020, received for corresponding European Application No. 19185504.8.

(Continued)

*Primary Examiner* — David E Sosnowski

*Assistant Examiner* — Jason G Davis

(74) *Attorney, Agent, or Firm* — Kinney & Lange, P.A.

(57) ABSTRACT

A vane stage includes a ringcase extending circumferentially about a center axis of the vane stage. The ringcase extends completely about the center axis to form a first ring. An inner shroud extends circumferentially about the center axis of the vane stage. The inner shroud extends completely about the center axis to form a second ring positioned radially within the ringcase relative the center axis. A plurality of stationary half vanes extend radially between the ringcase and the inner shroud, and are circumferentially spaced about the center axis. The plurality of stationary half vanes are integral with the ringcase and the inner shroud.

17 Claims, 10 Drawing Sheets

(56) References Cited

U.S. PATENT DOCUMENTS

| | | | | |
|---|---|---|---|---|
| 3,990,810 | A | 11/1976 | Amos et al. | |
| 4,856,962 | A * | 8/1989 | McDow | F01D 17/162 415/115 |
| 5,623,821 | A | 4/1997 | Bouiller et al. | |
| 6,619,916 | B1 | 9/2003 | Capozzi et al. | |
| 6,792,758 | B2 * | 9/2004 | Dowman | F01D 17/162 415/142 |
| 7,055,304 | B2 * | 6/2006 | Courtot | F01D 5/146 244/134 B |
| 7,114,911 | B2 * | 10/2006 | Martin | F04D 29/563 415/1 |
| 7,223,066 | B2 | 5/2007 | Rockley | |
| 7,549,839 | B2 * | 6/2009 | Carroll | F01D 5/148 415/161 |
| 8,986,797 | B2 * | 3/2015 | Xie | F01D 21/045 415/119 |
| 9,498,850 | B2 * | 11/2016 | Denis | B23K 31/02 |
| 9,803,559 | B2 | 10/2017 | Burdick et al. | |
| 2005/0109011 | A1 | 5/2005 | Courtot et al. | |
| 2012/0163960 | A1 | 6/2012 | Ress, Jr. et al. | |
| 2014/0064955 | A1 * | 3/2014 | Senter | F01D 9/042 415/209.3 |
| 2015/0361819 | A1 | 12/2015 | Epstein | |
| 2016/0108821 | A1 | 4/2016 | Robertson, Jr. et al. | |
| 2017/0191367 | A1 | 7/2017 | Sak et al. | |

FOREIGN PATENT DOCUMENTS

| | | | |
|---|---|---|---|
| EP | 1780378 | A3 | 10/2010 |
| EP | 3009607 | A1 | 4/2016 |
| EP | 3093442 | A1 | 11/2016 |
| EP | 3190268 | A1 | 7/2017 |

OTHER PUBLICATIONS

Extended European Search Report dated Oct. 30, 2019 received for corresponding European Application No. 19195967.5, 10 pages.

* cited by examiner

INTEGRAL HALF VANE, RINGCASE, AND ID SHROUD

CROSS-REFERENCE TO RELATED APPLICATION(S)

This application is a continuation-in-part of U.S. application Ser. No. 16/131,766 filed Sep. 14, 2018 for "INTEGRAL HALF VANE, RINCASE, AND ID SHROUD" by David M. Dyer, Zachary J. Jeske, Michael Ronan, Matthew E. Bintz, John P. Tirone, Scott Gammons, Michael C. Firnhaber, and Mark E. Simonds, which is incorporated by reference in its entirety.

STATEMENT OF GOVERNMENT INTEREST

This invention was made with Government support awarded by the United States. The Government has certain rights in this invention.

BACKGROUND

The present disclosure relates to variable area vanes in gas turbine engines.

Gas turbine engines typically include a compressor section, a combustor section, and a turbine section. During operation, air is pressurized in the compressor section, and is mixed with fuel and burned in the combustor section to generate hot combustion gases. The hot combustion gases are communicated through the turbine section, which extracts energy from the hot combustion gases to power the compressor section and other gas turbine engine loads.

Typically, both the compressor and turbine sections include alternating arrays of vanes and rotating blades that extend into a core airflow path of the gas turbine engine. For example, in the compressor section, compressor blades rotate to pull air into the compressor section for compression. The compressor vanes guide the airflow between different arrays (also called stages) of rotating blades and prepare the airflow for a downstream array of blades. Some compressor sections include variable area vanes, which include vanes that are moveable to vary the area or direction of the flow of the core airflow path between two stages of rotating blades. Movement of the variable area vanes is controlled to optimize the performance of the gas turbine engine during various operating conditions.

SUMMARY

In one aspect of the disclosure, a vane stage includes a ringcase extending circumferentially about a center axis of the vane stage. The ringcase extends completely about the center axis to form a first ring. An inner shroud extends circumferentially about the center axis of the vane stage. The inner shroud extends completely about the center axis to form a second ring positioned radially within the ringcase relative the center axis. A plurality of stationary half vanes extend radially between the ringcase and the inner shroud, and are circumferentially spaced about the center axis. The plurality of stationary half vanes are integral with the ringcase and the inner shroud.

In another aspect of the disclosure, a vane stage includes a ringcase extending circumferentially about a center axis of the vane stage. The ringcase extends completely about the center axis to form a first non-segmented ring. An inner shroud extends circumferentially about the center axis of the vane stage. The inner shroud extends completely about the center axis to form a second non-segmented ring radially within the ringcase relative the center axis. A plurality of stationary half vanes extend radially between the ringcase and the inner shroud. The plurality of stationary half vanes are circumferentially spaced about the center axis and are integrally connected to the ringcase and the inner shroud. Each of the plurality of stationary half vanes includes both a leading edge extending radially from the inner shroud to the ringcase, and a groove extending radially from the inner shroud to the ringcase aft of the leading edge. A partial suction surface extends radially from the inner shroud to the ringcase and extends axially from the leading edge to the groove. A partial pressure surface extends radially from the inner shroud to the ringcase and extends axially from the leading edge to the groove opposite the partial suction surface. The groove is positioned between the partial suction surface and the partial pressure surface.

In another aspect of the disclosure, a vane stage includes a ringcase extending circumferentially about a center axis of the vane stage. The ringcase extends completely about the center axis to form a first non-segmented ring. An inner shroud extends circumferentially about the center axis of the vane stage. The inner shroud extends completely about the center axis to form a second non-segmented ring positioned radially within the ringcase relative the center axis. A plurality of stationary half vanes extend radially between the ringcase and the inner shroud, and are circumferentially spaced about the center axis. The plurality of stationary half vanes are integral with the ringcase and the inner shroud. A plurality of trunnion holes are formed in the ringcase aft of the plurality of stationary half vanes. Each trunnion hole of the plurality of trunnion holes is circumferentially aligned with one of the plurality of stationary half vanes and extends radially through the ringcase.

Persons of ordinary skill in the art will recognize that other aspects and embodiments of the present disclosure are possible in view of the entirety of the present disclosure, including the accompanying figures.

Figure 1:
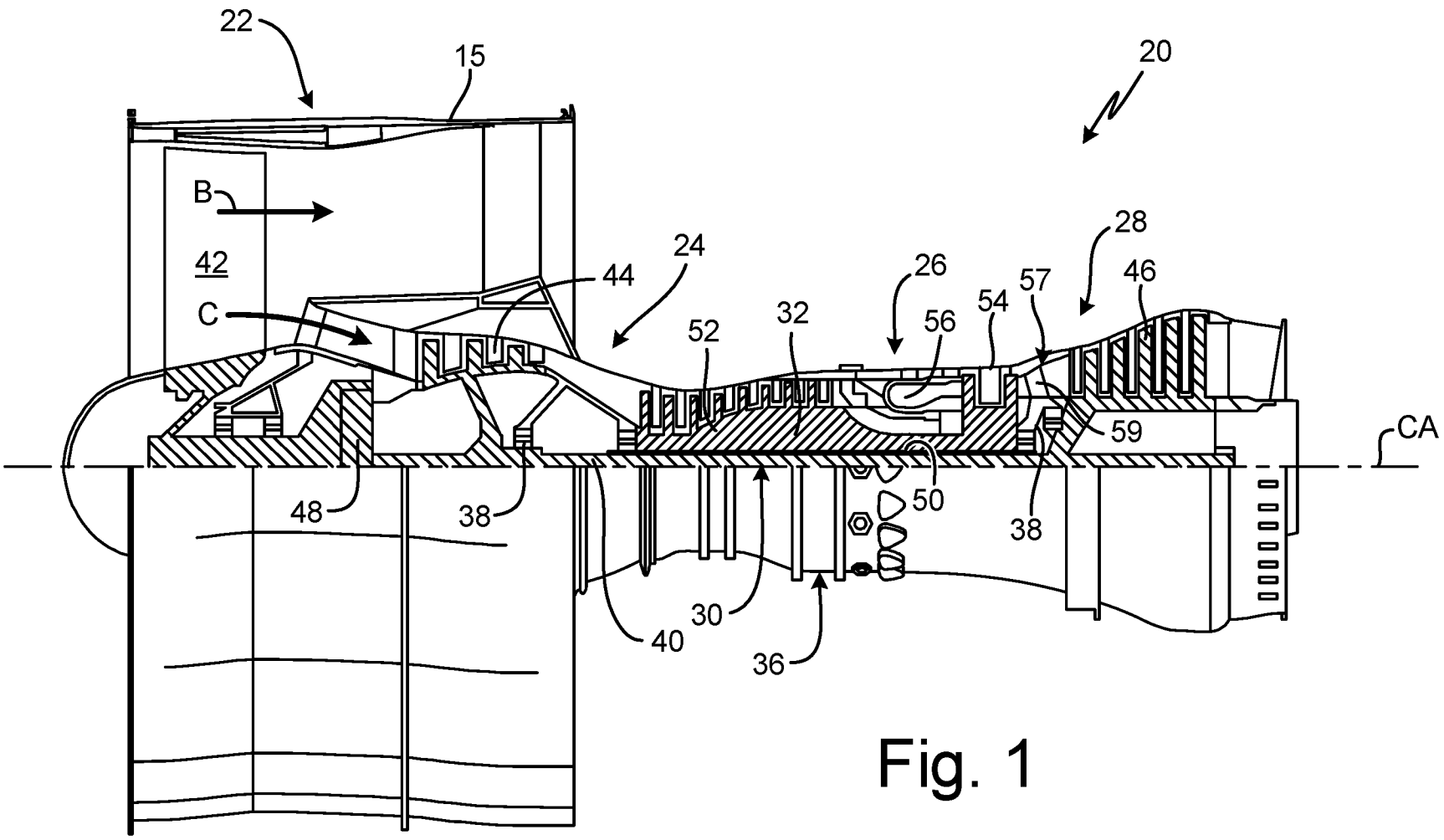
FIG. 1 is a partial cross-sectional view of a gas turbine engine.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The present disclosure provides a vane stage with an integral half vane structure with an outer ringcase, an inner shroud, and a plurality of stationary half vanes. Rotating variable half vanes are assembled onto the integral half vane structure aft of the stationary half vanes. Together, the stationary half vanes and the variable half vanes form an array of vanes where each vane has a fixed leading edge and an adjustable trailing edge that can be controlled to optimize the performance of a gas turbine engine during various operating conditions. Because the plurality of stationary half vanes, the outer ringcase and the inner shroud are integral, the position of stationary half vanes within integral half vane structure can be tightly controlled, which leads to tighter tolerances between the stationary half vanes and the variable half vanes. Tighter tolerances between the stationary half vanes and the variable vanes reduce flow irregularities across the vane stage. Making the ringcase, the inner shroud, and the plurality of stationary half vanes integral also reduces the number of parts and the weight of the vane stage when compared to traditional vane stages where vanes and shroud segments are fastened together into a vane pack.

FIG. 1 is a quarter-sectional view that schematically illustrates example gas turbine engine 20 that includes fan section 22, compressor section 24, combustor section 26 and turbine section 28. Fan section 22 drives air along bypass flow path B in bypass duct D while compressor section 24 draws air in along core flow path C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24. Although the disclosed non-limiting embodiment depicts a turbofan gas turbine engine, it should be understood that the concepts described herein are not limited to use with turbofans as the teachings may be applied to other types of turbine engines including three-spool architectures.

The example gas turbine engine 20 generally includes low speed spool 30 and high speed spool 32 mounted for rotation about center axis CA of gas turbine engine 20 relative to engine static structure 36 via several bearing assemblies 38. It should be understood that various bearing assemblies 38 at various locations may alternatively or additionally be provided.

Low speed spool 30 generally includes inner shaft 40 that connects fan 42 and low pressure (or first) compressor 44 to low pressure (or first) turbine 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor 52 and high pressure (or second) turbine 54. Inner shaft 40 and outer shaft 50 are concentric and rotate via bearing assemblies 38 about center axis CA.

Combustor 56 is arranged between high pressure compressor 52 and high pressure turbine 54. Mid-turbine frame 57 of engine static structure 36 can be arranged generally between high pressure turbine 54 and low pressure turbine 46. Mid-turbine frame 57 further supports bearing assemblies 38 in turbine section 28 as well as setting airflow entering the low pressure turbine 46. Mid-turbine frame 57 includes airfoils 59 which are in core flow path C. The air in core flow path C is compressed first by low pressure compressor 44 and then by high pressure compressor 52. Next, the air is mixed with fuel and ignited in combustor 56 to produce high speed exhaust gases that are then expanded through high pressure turbine 54, mid-turbine frame 58, and low pressure turbine 46. As discussed below with reference to FIGS. 2-4, compressor section 24 can include an integral half vane structure 60 that is used in a variable vane stage.

Figure 2:
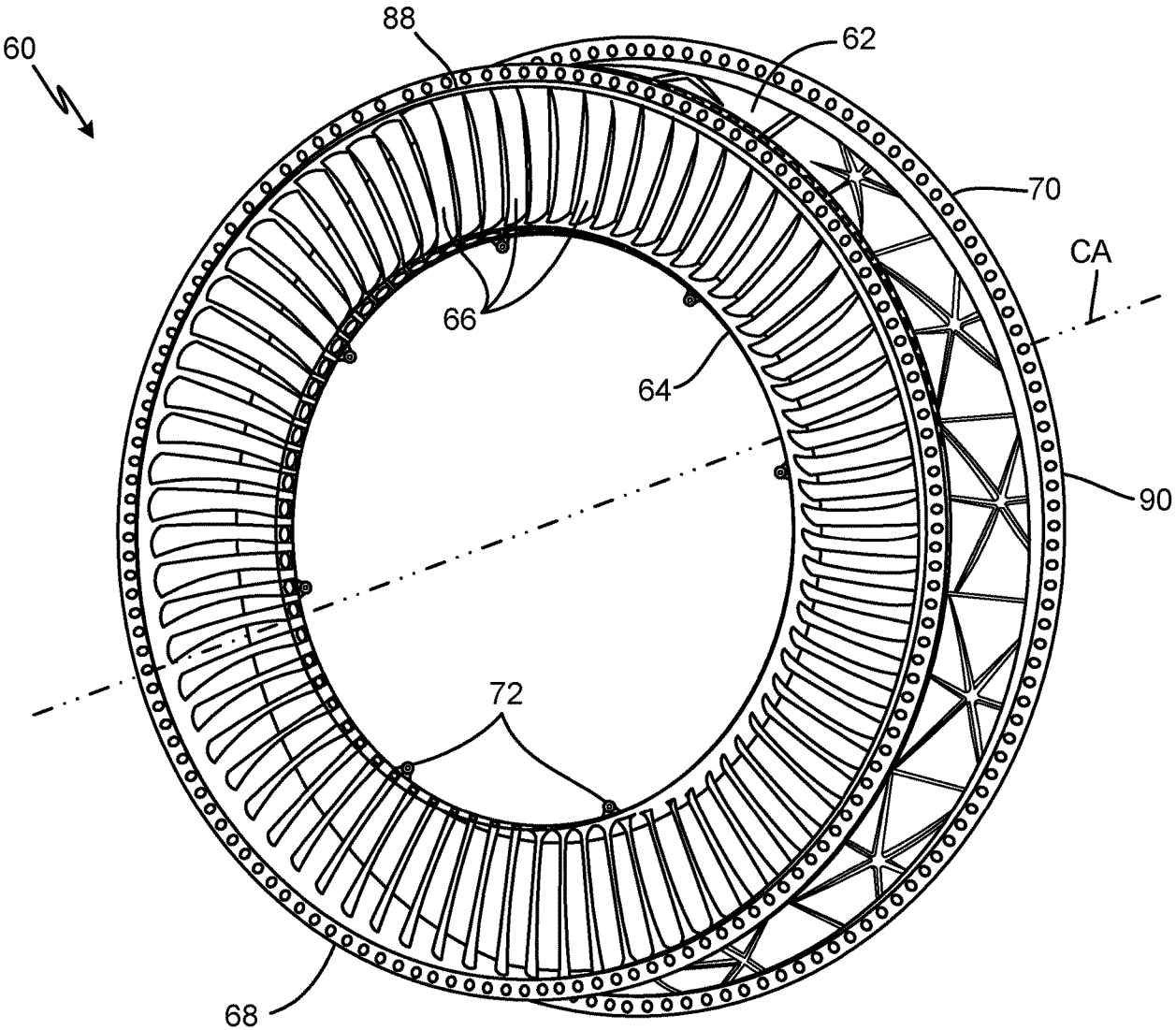
FIG. 2 is a perspective view of an integral half vane structure with an outer ringcase, and inner shroud, and a plurality of stationary half vanes.
Figure 3:
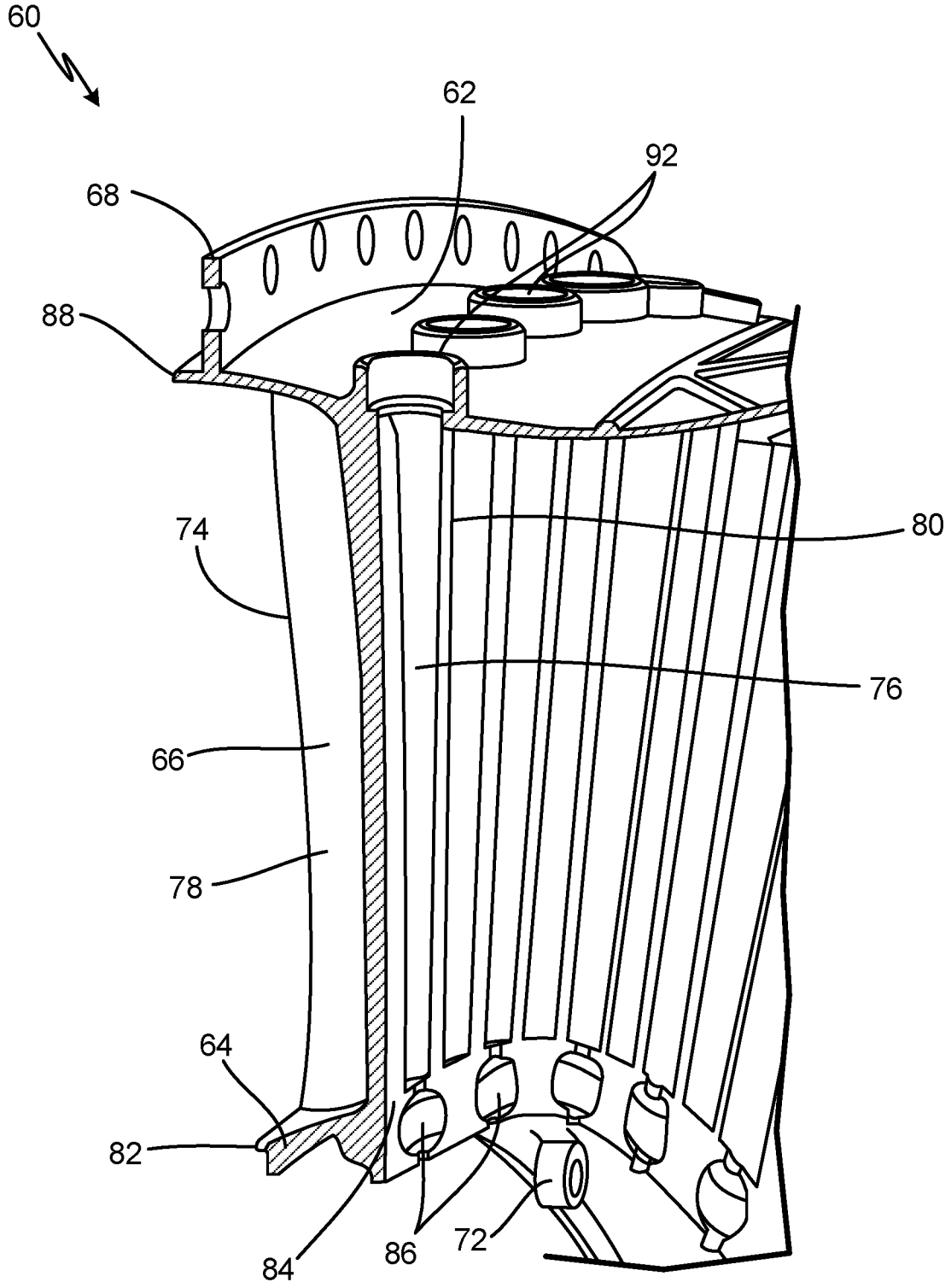
FIG. 3 is a perspective cross-sectional view of the integral half vane structure from FIG. 2 with the cross section taken in the axial-radial plane.
Figure 4:
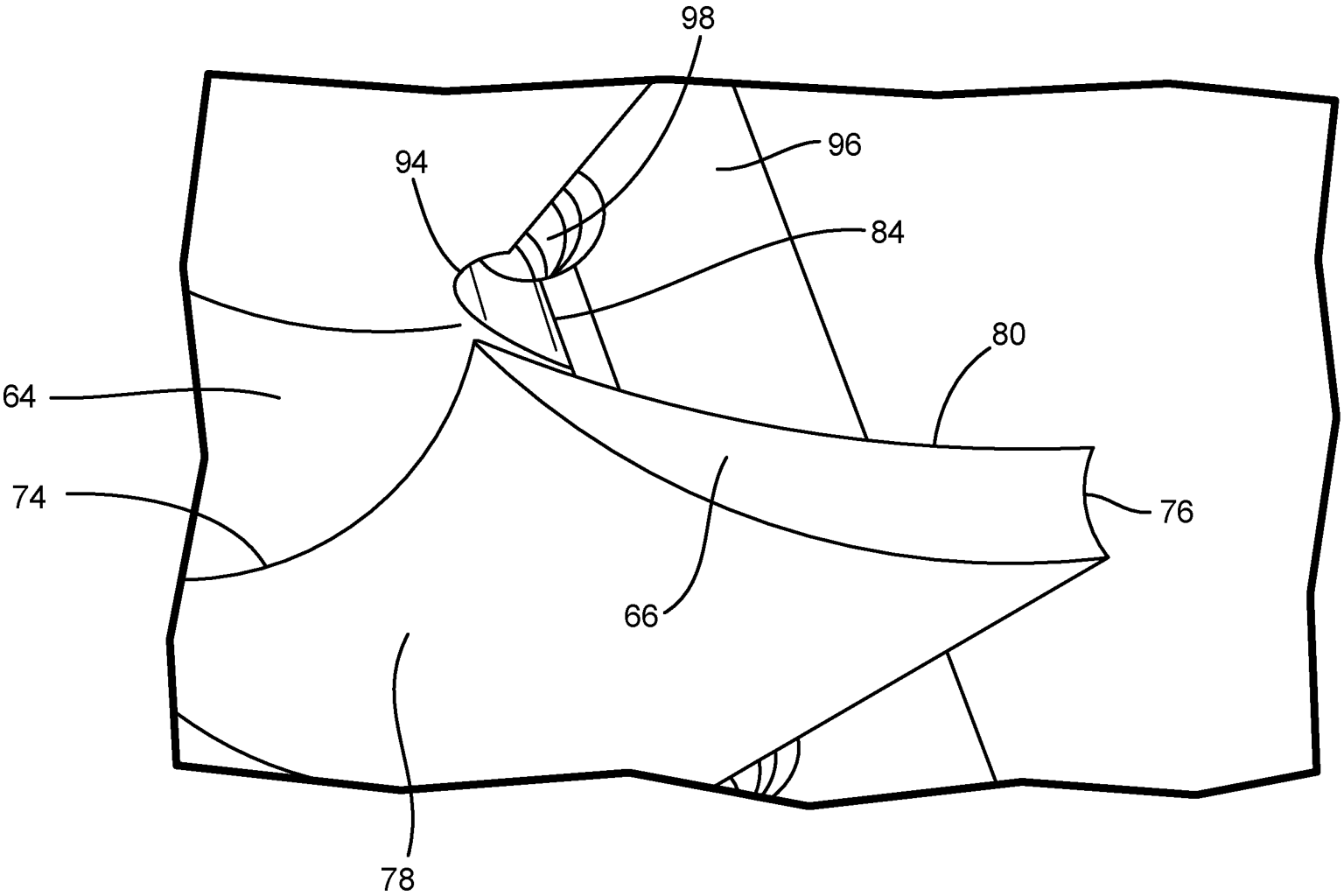
FIG. 4 is a perspective cross-sectional view of the integral half vane structure of FIGS. 2 and 3 with the cross section taken in the axial-circumferential plane.

FIGS. 2-4 will be discussed concurrently. FIG. 2 is a perspective view of integral half vane structure 60. FIG. 3 is a perspective cross-sectional view of integral half vane structure 60 with the cross section taken in the axial-radial plane. FIG. 4 is a perspective cross-sectional view of integral half vane structure 60 with the cross section taken in the axial-circumferential plane. As shown in FIGS. 2-4, integral half vane structure 60 includes ringcase 62, inner shroud 64, and a plurality of stationary half vanes 66. As shown best in FIG. 2, integral half vane structure 60 also includes forward flange 68 and aft flange 70 on ring case 62, and mounting tabs 72 on inner shroud 64. As shown best in FIGS. 3 and 4, each stationary half vane 66 in the plurality of half vanes 66 includes leading edge 74, groove 76, partial suction surface 78, and partial pressure surface 80. Inner shroud includes forward edge 82, aft edge 84, and a plurality of sockets 86. Ringcase 62 includes forward edge 88, aft edge 90 (shown in FIG. 2), and a plurality of outer trunnion holes 92. As shown best in FIG. 4, each stationary half vane 66 can also include undercut 94. Aft ring 96 and inner trunnion holes 98 are also shown in FIG. 4.

Ringcase 62 extends circumferentially about center axis CA. Ringcase 62 extends completely about center axis CA to form a first complete and non-segmented ring. Ringcase 62 extends axially from forward edge 88 to aft edge 90. Forward flange 68 is formed on forward edge 88 of ringcase 62 and extends radially outward from ringcase 62. Aft flange 70 is formed on aft edge 90 of ringcase 62 and extends radially outward from ringcase 62. Forward flange 68 and aft flange 70 are configured to allow ringcase 62 to be mounted between two axially-adjacent structures (not shown) in gas turbine engine 20. Inner shroud 64 also extends circumferentially about center axis CA. Similar to ringcase 62, inner shroud 64 extends completely about center axis CA to form a second complete and non-segmented ring. Inner shroud 64 is smaller in diameter than ringcase 62 and is positioned radially within ringcase 62 such that ringcase 62 and inner shroud 64 are concentric on central axis CA. Inner shroud 64 extends axially from forward edge 82 to aft edge 84. Mounting tabs 72 are formed on a radially inner surface of inner shroud 64 between forward edge 82 and aft edge 84. Mounting tabs 72 are circumferentially spaced from one another and extend radially inward from inner shroud 64. Mounting tabs 72 are provided to connect inner shroud 64 to forward and aft adjacent structures (such as aft ring 96 shown in FIG. 5) in gas turbine engine 20.

The plurality of stationary half vanes 66 extend radially between ringcase 62 and inner shroud 64 and connect ringcase 62 and inner shroud 64 together. Stationary half vanes 66 are spaced circumferentially about center axis CA. Stationary half vanes 66 are integral with ring case 62 and inner shroud 64. Integral half vane structure 60 can be formed by machining ringcase 62, inner shroud 64 and stationary half vanes 66 from a single piece of metal. Integral half vane structure 60 can also be made by first forming ringcase 62, welding a cylindrical plate (not shown) inside ringcase 62, and machining the cylindrical plate to form inner shroud 64 and stationary half vanes 66. Integral half vane structure 60 can also be made by separately forming ringcase 62, inner shroud 64, and stationary half vanes 66, and welding ringcase 62, inner shroud 64, and stationary half vanes 66 together. Integral half vane structure 60 can also be formed through additive manufacturing.

As shown best in FIGS. 3 and 4, leading edge 74 of each stationary half vane 66 extends radially from inner shroud 64 to ringcase 62. The body of stationary half vane 66 extends axially aft from leading edge 74. Groove 76 is formed on an aft end of stationary half vane 66 and is thus axially aft of leading edge 74. Groove 76 extends on stationary half vane 66 from inner shroud 64 to ringcase 62. In the embodiments of FIGS. 3 and 4, groove 76 has a concave cross-sectional profile such that groove 76 has a surface that curves axially forward into stationary half vane 66. Partial suction surface 78 of stationary half vane 66 extends radially from inner shroud 64 to ringcase 62 and extends axially from leading edge 74 to groove 76. Partial pressure surface 80 of stationary half vane 66 also extends radially from inner shroud 64 to ringcase 62 and extends axially from leading edge 74 to groove 76 opposite partial suction surface 78. Groove 76 is positioned between partial suction surface 78 and partial pressure surface 80 at the aft end of stationary half vane 66. As shown in FIG. 4, an undercut 94 can be formed between the aft end of each stationary half vane 66 and inner shroud 64 to reduce bending stress concentrations between half vane 66 and inner shroud 64 during operation of gas turbine engine 20 (shown in FIG. 1). Another undercut (shown in FIGS. 8 and 9) can be formed between the aft end of each stationary half vane 66 and ringcase 62 to reduce bending stress concentrations between half vane 66 and ringcase 62 during operation of gas turbine engine 20.

The plurality of outer trunnion holes 92 are formed in ringcase 62 aft of the plurality of stationary half vanes 66. Each of the outer trunnion holes 92 is circumferentially aligned with one of the plurality of stationary half vanes 66 and extends radially through ringcase 62 just aft of groove 76. A boss can be formed around each of the outer trunnion holes 92 to reinforce the circumference of the outer trunnion holes 92. The plurality of sockets 86 are formed on aft edge 84 of inner shroud 64. Each socket 86 of the plurality of sockets 86 is circumferentially aligned with one of the plurality of stationary half vanes 66. As shown best in FIG. 4, inner trunnion holes 98 are formed by inner shroud 64 and aft ring 96. Aft ring 96 abuts aft edge 84 of inner shroud 64 and is fastened to mounting tabs 72 of inner shroud 64. Half of each inner trunnion hole 98 is formed on aft edge 84 over one of the plurality of sockets 86, and the other half of each inner trunnion hole 98 is formed on aft ring 96. As discussed below with reference to FIGS. 5 and 6, groove 76 on each of stationary half vanes 66, the plurality of outer trunnion holes 92, the plurality of sockets 86, and the inner trunnion holes 98 are features that accommodate the assembly of a plurality of variable half vanes 100 onto integral half vane structure 60.

Figure 5:
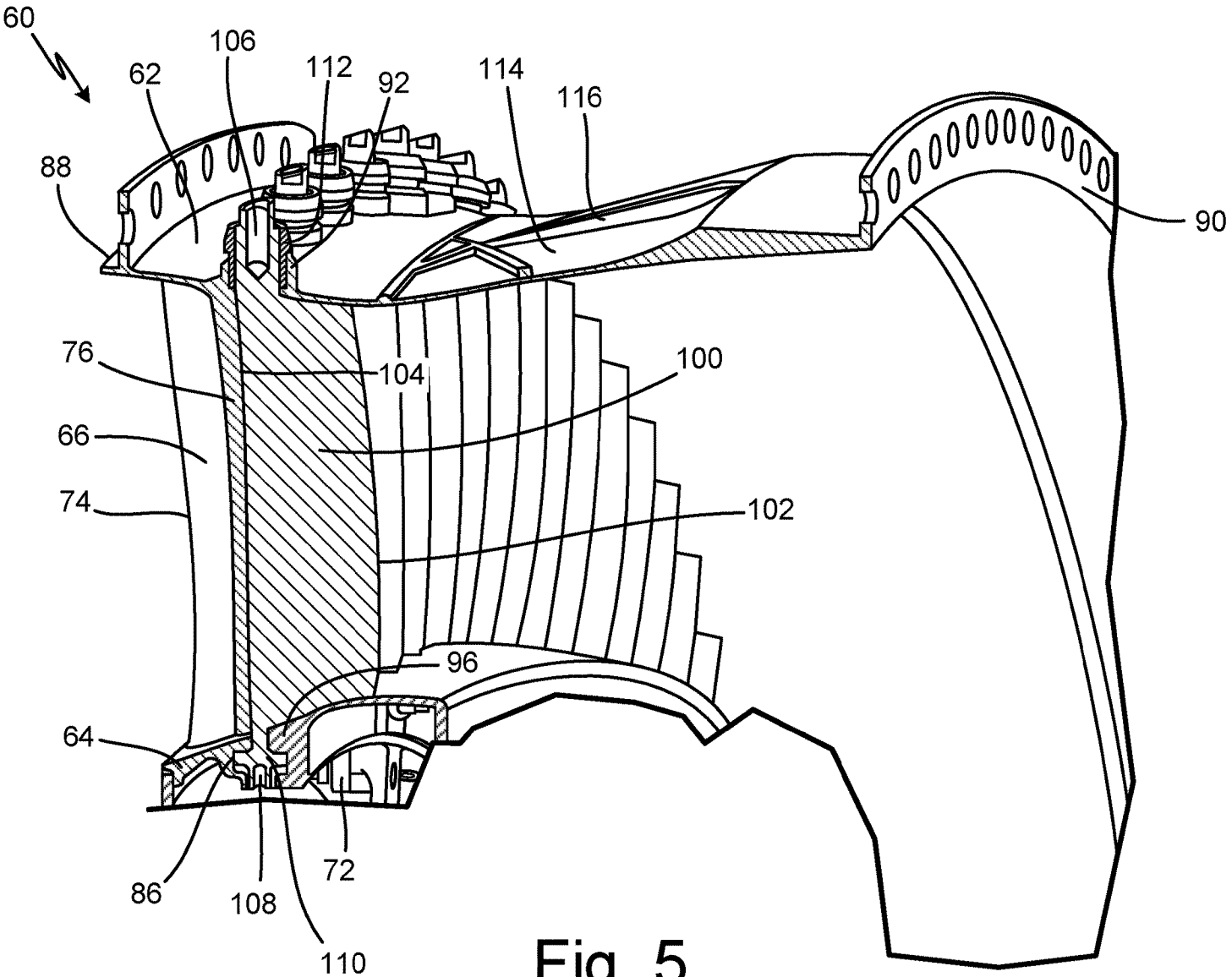
FIG. 5 is a cross-sectional view in the axial-radial plane of the integral half vane structure assembled with a plurality of rotating variable half vanes.
Figure 6:
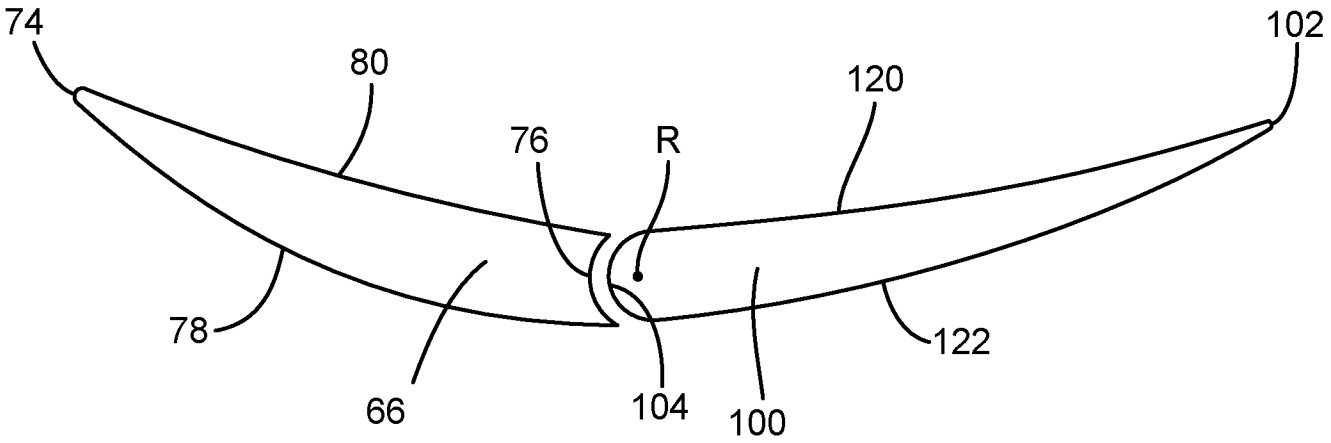
FIG. 6 is a cross-sectional view of one of the stationary half vanes and one of variable half vanes from FIG. 5.

FIGS. 5 and 6 will be discussed concurrently. FIG. 5 is a cross-sectional view in the axial-radial plane of integral half vane structure 60 assembled with a plurality of rotating variable half vanes 100. FIG. 6 is a cross-sectional view of one of the stationary half vanes 66 and one of the variable half vanes 100. Each one of the variable half vanes 100 in FIGS. 5 and 6 include trailing edge 102, joining edge 104, first trunnion 106, second trunnion 108, button 110, partial pressure surface 120, and partial suction surface 122. Trunnion nuts 112 and outer surface 114 and ribs 116 of ringcase 62 are shown in the embodiment of FIG. 5.

Each variable half vane 100 is assembled onto integral half vane structure 60 immediately aft of one of stationary half vanes 66. On each of variable half vanes 100, trailing edge 102 extends radially between inner shroud 64 and ringcase 62. Joining edge 104 is forward of trailing edge 102 and aft of groove 76. Joining edge 104 extends radially from inner shroud 64 to ringcase 62. As shown best in FIG. 6, joining edge 104 of each variable half vane 100 is configured to mate with groove 76 on the adjacent stationary half vane 66. In the embodiment of FIG. 6, joining edge 104 is rounded with a convex cross-sectional profile, so as to correspond with the concave profile of groove 76. Partial suction surface 122 of variable half vane 100 extends from joining edge 104 to trailing edge 102. Partial pressure surface 120 of variable half vane 100 extends from joining edge 104 to trailing edge 102 opposite partial suction surface 122. Partial suction surface 122 and partial pressure surface 120 of variable half vane 100 cooperate with partial suction surface 78 and partial pressure surface 80 of stationary half vane 66 respectively to create a complete airfoil profile that extends axially from leading edge 74 to trailing edge 102. The portion of the airfoil profile formed by stationary half vane 66 does not move or change position during operation of gas turbine engine 20 (shown in FIG. 1), whereas the portion of the airfoil profile formed by variable half vane 100 is able to pivot and move on axis R relative stationary half vane 66.

On each of variable half vanes 100, first trunnion 106 extends radially outward proximate joining edge 104 and into one of outer trunnion holes 92 on ringcase 62. Trunnion nut 112 is fastened to first trunnion 106 to fasten variable half vane 100 to ringcase 62. Second trunnion 108 extends radially inward proximate joining edge 104 and is positioned aft of aft edge 84 (shown in FIG. 3) of inner shroud 64. Second trunnion 108 extends through one of inner trunnion holes 98 (shown in FIG. 4). Button 110 is formed on second trunnion 108, and a portion of button 110 is received by one of the plurality of sockets 86 on inner shroud 64. The other portion of button 110 is housed within a pocket on aft ring 96. Button 110, socket 86, and the pocket on aft ring 96 work together to connect variable half vane 100 to inner shroud 64.

Aft ring 96 forms an inner diameter flow surface aft and downstream of stationary half vanes 66. Aft ring 96 also forms the inner diameter flow surface under at least a portion of variable half vanes 100. As shown in FIG. 5, ringcase 62 is axially longer than inner shroud 64 and extends aft of variable half vanes 100. In the embodiment of FIG. 5, ringcase 62 can be axially long enough such that aft end 90 of ringcase 62 can extend around a stage of rotor blades (not shown). Ringcase 62 can also increase in diameter from aft of stationary half vanes 66. Due to the longer axial length of ringcase 62, ribs 116 are formed on outer surface 114 of ringcase 62 to stiffen ringcase 62 against bending and other forces integral half vane structure 60 may encounter during operation of gas turbine engine 20 (shown in FIG. 1). The configuration of ribs 116 is discussed below with reference to FIG. 7.

Figure 7:
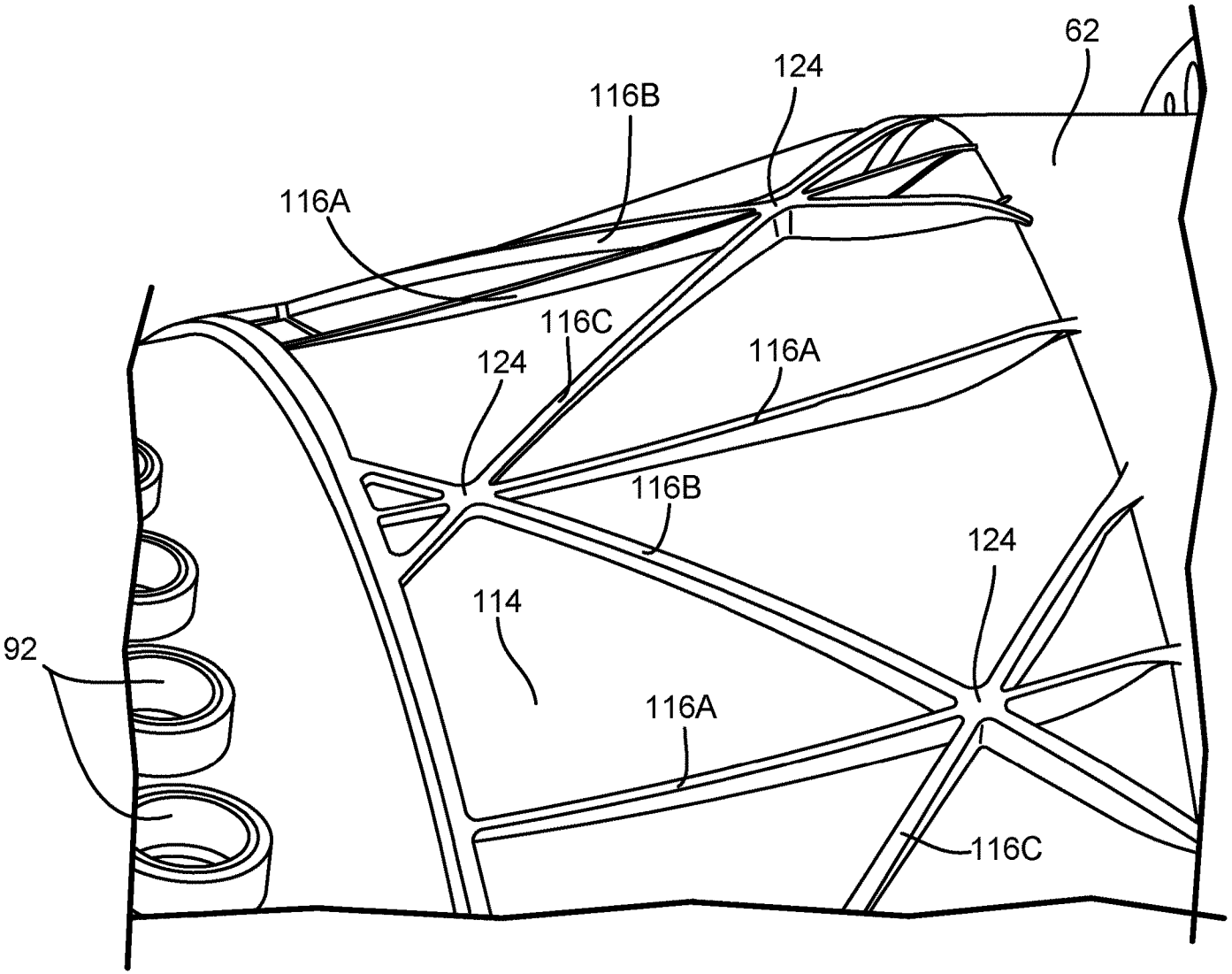
FIG. 7 is a perspective view of ribs on the outer surface of the ringcase of the integral half vane structure of FIGS. 1 and 5.

FIG. 7 is a perspective view of ribs 116 on outer surface 114 of ringcase 62. As shown in FIG. 7, ribs 116 include axial ribs 116A, first angled ribs 116B, and second angled ribs 116C. Ribs 116 also include nodes 124. Axial ribs 116A, first angled ribs 116B, and second angled ribs 116C are all formed on outer surface 114 of ringcase 62 aft of stationary half vanes 66 (shown in FIGS. 2-6). Axial ribs 116A extend on outer surface 114 parallel to center axis CA and are circumferentially spaced apart from one another on outer surface 114. First angled ribs 116B extend on outer surface 114 non parallel to center axis CA and intersect axial ribs 116A at nodes 124.

In the embodiment of FIG. 7, each of first angled ribs 116B intersect two axial ribs 116A. Second angled ribs 116C extend on outer surface 114 non parallel to center axis CA and intersect axial ribs 116A and first angled ribs 116B at nodes 124. In the embodiment of FIG. 7, each of second angled ribs 116C intersects two axial ribs 116A and two first angled ribs 116B. First angled ribs 116B can intersect second angled ribs 116C at a forty-five degree angle. As shown in FIG. 7, nodes 24 are not centered on axial ribs 116A, but alternate such that nodes 24 are on a forward portion of every other axial rib 116A and on an aft portion of the remaining axial ribs 116A. Alternating the position of nodes 24 on axial ribs 116A distributes ribs 116 on outer surface 114 of ringcase 62 such that ribs 116 evenly reinforce ringcase 62. Axial ribs 116A, first angled ribs 116B, and second angled ribs 116C all increase in radial thickness in the axially aft direction to accommodate the increasing diameter of ringcase 62, as discussed above with reference to FIG. 5.

Figure 8:
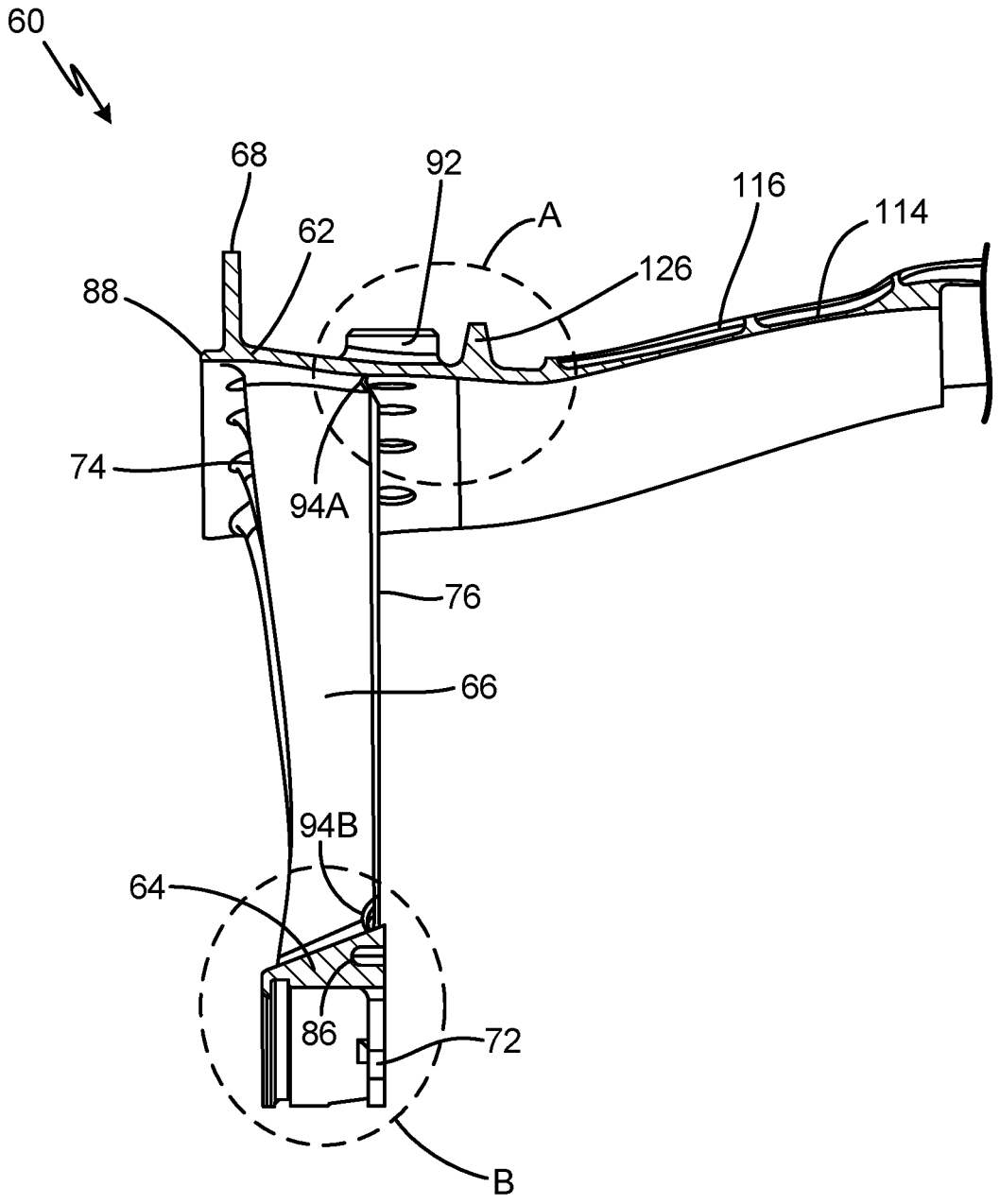
FIG. 8 is a perspective cross-sectional view of another embodiment of the integral half vane structure with an outer ringcase, and inner shroud, and a plurality of stationary half vanes, with the cross section taken in the axial-radial plane.
Figure 9:
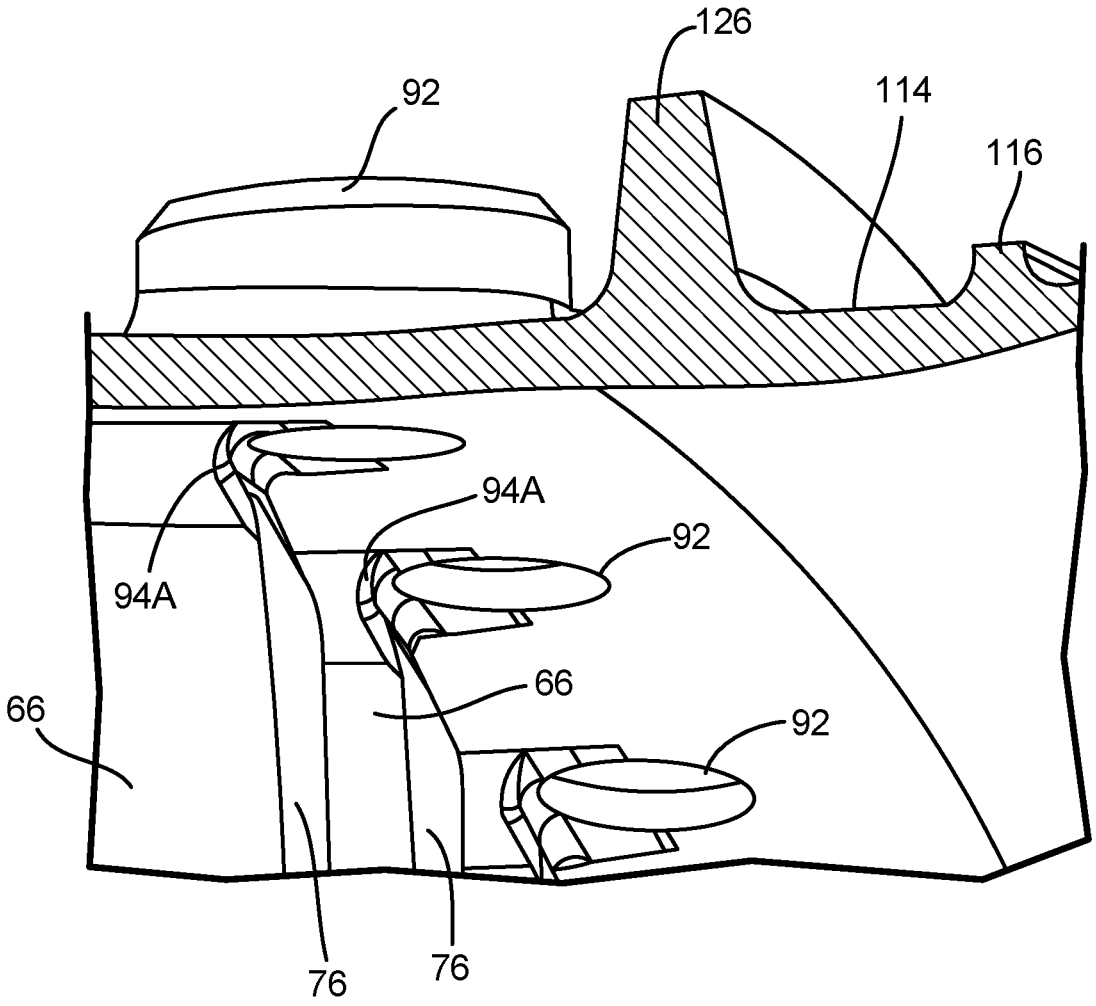
FIG. 9 is an enlarged perspective cross-sectional view of the outer ringcase and the plurality of stationary half vanes taken from Circle A in FIG. 8.
Figure 10:
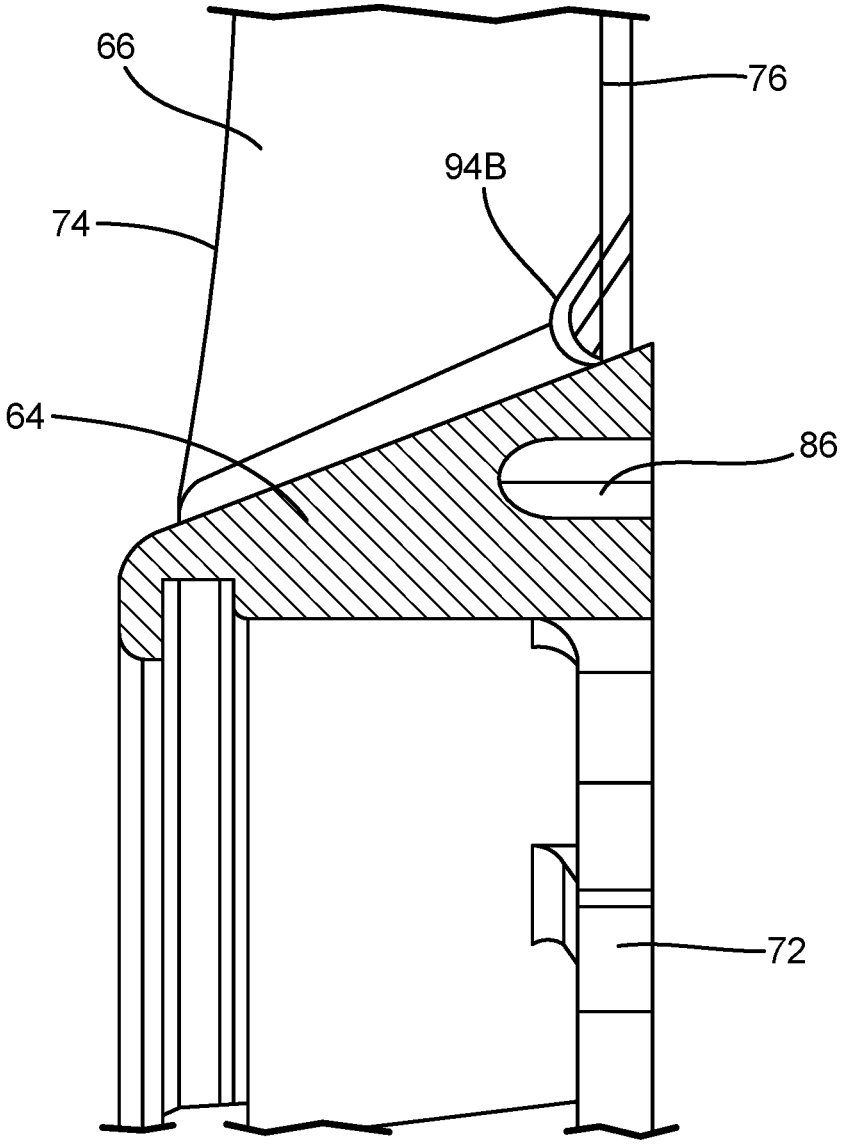
FIG. 10 is an enlarged perspective cross-sectional view of the inner shroud and the plurality of stationary half vanes taken from Circle B in FIG. 8.

FIGS. 8-10 will be discussed concurrently. FIGS. 8-10 disclose another embodiment of integral half vane structure 60 with additional features that strengthen and alleviate stress in integral half vane structure 60. FIG. 8 is a perspective cross-sectional view of integral half vane structure 60 with circumferential rib 126 formed on ringcase 62, and first undercuts 94A and second undercuts 94B both formed on stationary half vanes 66. FIG. 9 is an enlarged view, taken from Circle A in FIG. 8, of ringcase 62, outer trunnion holes 92, circumferential rib 126, stationary half vanes 66, and first undercuts 94A. FIG. 10 is an enlarged view, taken from Circle B in FIG. 8, of inner shroud 64, stationary half vanes 66, and second undercuts 94B.

As shown in FIGS. 8 and 9, circumferential rib 126 is formed on outer surface 114 of ringcase 62 and extends radially outward from ringcase 62. Circumferential rib 126 extends the full circumference of ringcase 62. Circumferential rib 126 is positioned on ringcase 62 axially forward of ribs 116 and axially aft of stationary half vanes 66 and outer trunnion holes 92. Circumferential rib 126 can be positioned over variable half vanes 100 (shown in FIG. 5) such that circumferential rib 126 extends around variable half vanes 100. Circumferential rib 126 stiffens ringcase 62 against case pressures that act on ringcase 62, reducing stress that is concentrated between the junction of stationary half vanes 66 and ringcase 62 during operation of gas turbine engine 20 (shown in FIG. 1).

On each stationary half vane 66, first undercut 94A is formed on an aft end of stationary half vane 66 between groove 76 and ringcase 62. As shown in FIGS. 8 and 10, second undercut 94B is formed on the aft end of each stationary half vane 66 between groove 76 and inner shroud 64. During operation of gas turbine engine 20, pressure inside ringcase 62 imparts stress onto ringcase 62. Because stationary half vanes 66 are integral with ringcase 62, stress is transferred from ringcase 62 to stationary half vanes 66 and inner shroud 64. First undercuts 94A and second undercuts 94B reduce the amount of stress that is concentrated between both the junction of stationary half vanes 66 and ringcase 62 and the junction of stationary half vanes 66 and inner shroud 64. First undercuts 94A and second undercuts 94B sufficiently reduce the stress concentrations in stationary half canes 66 such that integral half vane structure 60 can be formed from lightweight materials, like titanium.

In view of the foregoing description, it will be recognized that the present disclosure provides numerous advantages and benefits. For example, the present disclosure provides integral half vane structure 60 with ringcase 62, inner shroud 64, and a plurality of stationary half vanes 66. Stationary half vanes 66 are integral with ring case 62 and inner shroud 64. Because stationary half vanes 66 are integral with ring case 62 and inner shroud 64, the position of each stationary half vane 66 can be tightly controlled during manufacturing and does not shift or vary like prior art vane assemblies. Furthermore, by making stationary half vanes 66 integral with ringcase 62 and inner shroud 64, fewer parts, fasteners, and overall mass are required to assemble a vane stage that incorporates integral half vane structure 60 than prior art vane assemblies. The inclusion of circumferential rib 126 and ribs 116 stiffens ringcase 62 and allows ringcase 62 to be longer and encircle a downstream stage of rotor blades (not shown). First and second undercuts 94A, 94B on integral half vane structure 60 sufficiently reduce stress concentrations in integral half vane structure 60 during operation to allow integral half vane structure 60 to be made from titanium or other lightweight materials with similar properties.

The following are non-exclusive descriptions of possible embodiments of the present invention.

In one embodiment, a vane stage includes a ringcase extending circumferentially about a center axis of the vane stage. The ringcase extends completely about the center axis to form a first ring. An inner shroud extends circumferentially about the center axis of the vane stage. The inner shroud extends completely about the center axis to form a second ring positioned radially within the ringcase relative the center axis. A plurality of stationary half vanes extend radially between the ringcase and the inner shroud, and are circumferentially spaced about the center axis. The plurality of stationary half vanes are integral with the ringcase and the inner shroud.

The vane stage of the preceding paragraph can optionally include, additionally and/or alternatively, any one or more of the following features, configurations and/or additional components:

each of the plurality of stationary half vanes further comprises: a first undercut formed between the ringcase and the aft end of the stationary half vane; and a second undercut formed between the inner shroud and an aft end of the stationary half vane;

the ringcase further comprise: a circumferential rib extending radially outward from the ringcase aft of the plurality of stationary half vanes and forward of an aft end of the ringcase, wherein the circumferential rib extends circumferentially around the ringcase;

each of the plurality of stationary half vanes comprises: a leading edge extending radially from the inner shroud to the ringcase; a concave groove extending radially from the inner shroud to the ringcase and aft of the leading edge; a partial suction surface extending radially from the inner shroud to the ringcase and extending axially from the leading edge to the concave groove; and a partial pressure surface extending radially from the inner shroud to the ringcase and extending axially from the leading edge to the concave groove opposite the partial suction surface, and wherein the concave groove is positioned between the partial suction surface and the partial pressure surface;

a plurality of trunnion holes formed in the ringcase, wherein each trunnion hole of the plurality of trunnion holes is circumferentially aligned with one of the plurality of stationary half vanes and extends radially through the ringcase aft of the concave groove, and wherein the circumferential rib is aft of the plurality of trunnion holes;

a plurality of variable half vanes, wherein each of the plurality of variable half vanes comprises: a trailing edge extending radially between the inner shroud and the ringcase; a convex edge extending radially from the inner shroud to the ringcase, wherein the convex edge is forward of the trailing edge and configured to mate with the concave groove of one of the plurality of stationary half vanes; a first trunnion extending radially from the convex edge into one of the plurality of trunnion holes; and a second trunnion extending radially from the convex edge opposite the first trunnion, wherein the second trunnion is aft of the aft edge of the inner shroud;

the ringcase is axially longer than the inner shroud and increases in diameter aft of the plurality of stationary half vanes;

the ringcase comprises a plurality of ribs formed on an outer surface of the ringcase aft of the circumferential rib, wherein each of the plurality of ribs increases in radial thickness in an aft direction; and/or the plurality of ribs comprises: an axial rib extending parallel to the center axis; a first angled rib intersecting the axial rib at a node; and a second angled rib intersecting the axial rib and the first angled rib at the node.

In another embodiment, a vane stage includes a ringcase extending circumferentially about a center axis of the vane stage. The ringcase extends completely about the center axis to form a first non-segmented ring. An inner shroud extends circumferentially about the center axis of the vane stage. The inner shroud extends completely about the center axis to form a second non-segmented ring radially within the ringcase relative the center axis. A plurality of stationary half vanes extend radially between the ringcase and the inner shroud. The plurality of stationary half vanes are circumferentially spaced about the center axis and are integrally connected to the ringcase and the inner shroud. Each of the plurality of stationary half vanes includes both a leading edge extending radially from the inner shroud to the ringcase, and a groove extending radially from the inner shroud to the ringcase aft of the leading edge. A partial suction surface extends radially from the inner shroud to the ringcase and extends axially from the leading edge to the groove. A partial pressure surface extends radially from the inner shroud to the ringcase and extends axially from the leading edge to the groove opposite the partial suction surface. The groove is positioned between the partial suction surface and the partial pressure surface.

The vane stage of the preceding paragraph can optionally include, additionally and/or alternatively, any one or more of the following features, configurations and/or additional components:

each of the plurality of stationary half vanes further comprises: a first undercut formed between the groove and the ringcase and a second undercut formed between the groove and the inner shroud;

the ringcase is axially longer than the inner shroud and the ringcase further comprises: a rib extending radially outward from the ringcase aft of the plurality of stationary half vanes and forward of an aft end of the ringcase, wherein the rib extends circumferentially around the ringcase;

a plurality of trunnion holes formed in the ringcase, wherein each trunnion hole of the plurality of trunnion holes is circumferentially aligned with one of the plurality of stationary half vanes and extends radially through the ringcase aft of the groove; and/or a plurality of variable half vanes, wherein each of the plurality of variable half vanes comprises: a trailing edge extending radially between the inner shroud and the ringcase; a joining edge extending radially from the inner shroud to the ringcase, wherein the joining edge is forward of the trailing edge and configured to mate with the groove of one of the plurality of stationary half vanes; a first trunnion extending radially from the joining edge into one of the plurality of trunnion holes; and a second trunnion extending radially from the joining edge opposite the first trunnion, wherein the second trunnion is aft of the aft edge of the inner shroud.

In another embodiment, a vane stage includes a ringcase extending circumferentially about a center axis of the vane stage. The ringcase extends completely about the center axis to form a first non-segmented ring. An inner shroud extends circumferentially about the center axis of the vane stage. The inner shroud extends completely about the center axis to form a second non-segmented ring positioned radially within the ringcase relative the center axis. A plurality of stationary half vanes extend radially between the ringcase and the inner shroud, and are circumferentially spaced about the center axis. The plurality of stationary half vanes are integral with the ringcase and the inner shroud. A plurality of trunnion holes are formed in the ringcase aft of the plurality of stationary half vanes. Each trunnion hole of the plurality of trunnion holes is circumferentially aligned with one of the plurality of stationary half vanes and extends radially through the ringcase.

The vane stage of the preceding paragraph can optionally include, additionally and/or alternatively, any one or more of the following features, configurations and/or additional components:

the ringcase further comprises: a rib extending radially outward from the ringcase aft of the plurality of trunnion holes and forward of an aft end of the ringcase, wherein the rib extends circumferentially around the ringcase;

each of the plurality of stationary half vanes comprises: a leading edge extending radially from the inner shroud to the ringcase; a groove extending radially from the inner shroud to the ringcase and aft of the leading edge, wherein the groove has a concave cross-sectional profile; a partial suction surface extending radially from the inner shroud to the ringcase and extending axially from the leading edge to the groove; and a partial pressure surface extending radially from the inner shroud to the ringcase and extending axially from the leading edge to the groove opposite the partial suction surface, and wherein the groove is positioned between the partial suction surface and the partial pressure surface;

each of the plurality of stationary half vanes further comprises: a first undercut formed between the groove and the ringcase; and a second undercut formed between the groove and the inner shroud;

a plurality of variable half vanes, wherein each of the plurality of variable half vanes comprises: a trailing edge extending radially between the inner shroud and the ringcase; a joining edge extending radially from the inner shroud to the ringcase, wherein the joining edge is forward of the trailing edge and configured to mate with the groove of one of the plurality of stationary half vanes; a first trunnion extending radially from the joining edge into one of the plurality of trunnion holes; and a second trunnion extending radially from the convex edge opposite the first trunnion, wherein the second trunnion is aft of an aft edge of the inner shroud; and/or the rib extends circumferentially around the plurality of variable half vanes.

Any relative terms or terms of degree used herein, such as "substantially", "essentially", "generally", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, while FIGS. 1-10 disclose integral half vane structure 60 being used in compressor section 24, integral half vane structure 60 can be adapted for use in turbine section 28. Therefore, it is intended that the invention not be limited to the particular embodiment(s) disclosed, but that the invention will include all embodiments falling within the scope of the appended claims.

The invention claimed is:

1. A vane stage comprising:

a ringcase extending circumferentially about a center axis of the vane stage, wherein the ringcase extends completely about the center axis to form a first ring;

an inner shroud extending circumferentially about the center axis of the vane stage, wherein the inner shroud extends completely about the center axis to form a second ring positioned radially within the ringcase relative the center axis; and a plurality of stationary half vanes extending radially between the ringcase and the inner shroud, wherein the plurality of stationary half vanes are circumferentially spaced about the center axis;

wherein the plurality of stationary half vanes are integral with the ringcase and the inner shroud;

wherein the ringcase is axially longer than the inner shroud and increases in diameter aft of the plurality of stationary half vanes; and wherein the ringcase comprises:

a plurality of ribs formed on an outer surface of the ringcase aft of the plurality of stationary half vanes, each of the plurality of ribs increasing in radial thickness in an aft direction, wherein each of the plurality of ribs comprises:

an axial rib extending parallel to the center axis;

a first angled rib intersecting the axial rib at a node; and a second angled rib intersecting the axial rib and the first angled rib at the node.

2. The vane stage of claim 1, wherein each of the plurality of stationary half vanes further comprises:

a first undercut formed between the ringcase and an aft end of the stationary half vane; and a second undercut formed between the inner shroud and the aft end of the stationary half vane.

3. The vane stage of claim 2, wherein the ringcase further comprise:

a circumferential rib extending radially outward from the ringcase aft of the plurality of stationary half vanes and forward of an aft end of the ringcase, wherein the circumferential rib extends circumferentially around the ringcase.

4. The vane stage of claim 3, wherein each of the plurality of stationary half vanes comprises:

a leading edge extending radially from the inner shroud to the ringcase;

a concave groove extending radially from the inner shroud to the ringcase and aft of the leading edge;

a partial suction surface extending radially from the inner shroud to the ringcase and extending axially from the leading edge to the concave groove; and a partial pressure surface extending radially from the inner shroud to the ringcase and extending axially from the leading edge to the concave groove opposite the partial suction surface, and wherein the concave groove is positioned between the partial suction surface and the partial pressure surface.

5. The vane stage of claim 4 further comprising:

a plurality of trunnion holes formed in the ringcase, wherein each trunnion hole of the plurality of trunnion holes is circumferentially aligned with one of the plurality of stationary half vanes and extends radially through the ringcase aft of the concave groove, and wherein the circumferential rib is aft of the plurality of trunnion holes.

6. The vane stage of claim 5 further comprising:

a plurality of variable half vanes, wherein each of the plurality of variable half vanes comprises:

a trailing edge extending radially between the inner shroud and the ringcase;

a convex edge extending radially from the inner shroud to the ringcase, wherein the convex edge is forward of the trailing edge and configured to mate with the concave groove of one of the plurality of stationary half vanes;

a first trunnion extending radially from the convex edge into one of the plurality of trunnion holes; and a second trunnion extending radially from the convex edge opposite the first trunnion, wherein the second trunnion is aft of the aft edge of the inner shroud.

7. A vane stage comprising:

a ringcase extending circumferentially about a center axis of the vane stage, wherein the ringcase extends completely about the center axis to form a first non-segmented ring;

an inner shroud extending circumferentially about the center axis of the vane stage, wherein the inner shroud extends completely about the center axis to form a second non-segmented ring radially within the ringcase relative the center axis; and a plurality of stationary half vanes extending radially between the ringcase and the inner shroud, wherein the plurality of stationary half vanes are circumferentially spaced about the center axis and are integrally connected to the ringcase and the inner shroud, and wherein each of the plurality of stationary half vanes comprises:

a leading edge extending radially from the inner shroud to the ringcase;

a groove extending radially from the inner shroud to the ringcase and aft of the leading edge;

a partial suction surface extending radially from the inner shroud to the ringcase and extending axially from the leading edge to the groove; and a partial pressure surface extending radially from the inner shroud to the ringcase and extending axially from the leading edge to the groove opposite the partial suction surface;

wherein the groove is positioned between the partial suction surface and the partial pressure surface;

wherein the ringcase is axially longer than the inner shroud and increases in diameter aft of the plurality of stationary half vanes; and wherein the ringcase comprises:

a plurality of ribs formed on an outer surface of the ringcase aft of the plurality of stationary half vanes, each of the plurality of ribs increasing in radial thickness in an aft direction, wherein each of the plurality of ribs comprises:

an axial rib extending parallel to the center axis;

a first angled rib intersecting the axial rib at a node; and a second angled rib intersecting the axial rib and the first angled rib at the node.

8. The vane stage of claim 7, wherein each of the plurality of stationary half vanes further comprises:

a first undercut formed between the groove and the ringcase; and a second undercut formed between the groove and the inner shroud.

9. The vane stage of claim 8, wherein the ringcase further comprises:

a circumferential rib extending radially outward from the ringcase aft of the plurality of stationary half vanes and forward of an aft end of the ringcase, wherein the circumferential rib extends circumferentially around the ringcase.

10. The vane stage of claim 8 further comprising:

a plurality of trunnion holes formed in the ringcase, wherein each trunnion hole of the plurality of trunnion holes is circumferentially aligned with one of the plurality of stationary half vanes and extends radially through the ringcase aft of the groove.

11. The vane stage of claim 10 further comprising:

a plurality of variable half vanes, wherein each of the plurality of variable half vanes comprises:

a trailing edge extending radially between the inner shroud and the ringcase;

a joining edge extending radially from the inner shroud to the ringcase, wherein the joining edge is forward of the trailing edge and configured to mate with the groove of one of the plurality of stationary half vanes;

a first trunnion extending radially from the joining edge into one of the plurality of trunnion holes; and a second trunnion extending radially from the joining edge opposite the first trunnion, wherein the second trunnion is aft of the aft edge of the inner shroud.

12. A vane stage comprising:

a ringcase extending circumferentially about a center axis of the vane stage, wherein the ringcase extends completely about the center axis to form a first non-segmented ring;

an inner shroud extending circumferentially about the center axis of the vane stage, wherein the inner shroud extends completely about the center axis to form a second non-segmented ring positioned radially within the ringcase relative the center axis;

a plurality of stationary half vanes extending radially between the ringcase and the inner shroud, wherein the plurality of stationary half vanes are circumferentially spaced about the center axis, and wherein the plurality of stationary half vanes are integral with the ringcase and the inner shroud; and a plurality of trunnion holes formed in the ringcase aft of the plurality of stationary half vanes, wherein each trunnion hole of the plurality of trunnion holes is circumferentially aligned with one of the plurality of stationary half vanes and extends radially through the ringcase;

wherein the ringcase is axially longer than the inner shroud and increases in diameter aft of the plurality of stationary half vanes; and wherein the ringcase comprises:

a plurality of ribs formed on an outer surface of the ringcase aft of the plurality of stationary half vanes, each of the plurality of ribs increasing in radial thickness in an aft direction, wherein each of the plurality of ribs comprises:

an axial rib extending parallel to the center axis;

a first angled rib intersecting the axial rib at a node; and a second angled rib intersecting the axial rib and the first angled rib at the node.

13. The vane stage of claim 12, wherein the ringcase further comprises:

a circumferential rib extending radially outward from the ringcase aft of the plurality of trunnion holes and forward of an aft end of the ringcase, wherein the circumferential rib extends circumferentially around the ringcase.

14. The vane stage of claim 13, wherein each of the plurality of stationary half vanes comprises:

a leading edge extending radially from the inner shroud to the ringcase;

a groove extending radially from the inner shroud to the ringcase and aft of the leading edge, wherein the groove has a concave cross-sectional profile;

a partial suction surface extending radially from the inner shroud to the ringcase and extending axially from the leading edge to the groove; and a partial pressure surface extending radially from the inner shroud to the ringcase and extending axially from the leading edge to the groove opposite the partial suction surface, and wherein the groove is positioned between the partial suction surface and the partial pressure surface.

15. The vane stage of claim 14, wherein each of the plurality of stationary half vanes further comprises:

a first undercut formed between the groove and the ringcase; and a second undercut formed between the groove and the inner shroud.

16. The vane stage of claim 15 further comprising:

a plurality of variable half vanes, wherein each of the plurality of variable half vanes comprises:

a trailing edge extending radially between the inner shroud and the ringcase;

a joining edge extending radially from the inner shroud to the ringcase, wherein the joining edge is forward of the trailing edge and configured to mate with the groove of one of the plurality of stationary half vanes;

a first trunnion extending radially from the joining edge into one of the plurality of trunnion holes; and a second trunnion extending radially from the convex edge opposite the first trunnion, wherein the second trunnion is aft of an aft edge of the inner shroud.

17. The vane stage of claim 16, wherein the circumferential rib extends circumferentially around the plurality of variable half vanes.

* * * * *